US007751284B2

(12) United States Patent
Tang

(10) Patent No.: US 7,751,284 B2
(45) Date of Patent: Jul. 6, 2010

(54) SELF-MOVING ALARM CLOCK

(75) Inventor: Aaron S. Tang, Somerville, MA (US)

(73) Assignee: Edison Nation, LLC, Charlotte, NC (US)

( * ) Notice: Subject to any disclaimer, the term of this patent is extended or adjusted under 35 U.S.C. 154(b) by 177 days.

(21) Appl. No.: 11/379,903

(22) Filed: Apr. 24, 2006

(65) Prior Publication Data

US 2007/0008825 A1 Jan. 11, 2007

Related U.S. Application Data

(60) Provisional application No. 60/696,547, filed on Jul. 6, 2005, provisional application No. 60/772,512, filed on Feb. 13, 2006.

(51) Int. Cl.
*G04B 23/02* (2006.01)

(52) U.S. Cl. ..... 368/73

(58) Field of Classification Search ..... 368/73, 368/12, 69, 72, 262–263, 250, 276, 243
See application file for complete search history.

(56) References Cited

U.S. PATENT DOCUMENTS

| | | | | | |
|---|---|---|---|---|---|
| 4,287,964 | A * | 9/1981 | Sollenberger | ..... | 185/38 |
| 4,585,358 | A * | 4/1986 | Shay | ..... | 368/262 |
| 4,702,614 | A * | 10/1987 | Copley et al. | ..... | 368/72 |
| 5,023,853 | A | 6/1991 | Kawata et al. | ..... | 368/230 |
| 5,089,998 | A | 2/1992 | Rund | ..... | 358/72 |
| 5,095,468 | A | 3/1992 | Sato | ..... | 368/72 |
| 5,144,600 | A | 9/1992 | Cheng | ..... | 368/12 |
| 5,297,981 | A * | 3/1994 | Maxim et al. | ..... | 446/437 |
| 5,425,006 | A * | 6/1995 | Ya | ..... | 368/262 |
| 5,568,452 | A * | 10/1996 | Kronenberg | ..... | 368/262 |
| 5,892,350 | A * | 4/1999 | Yoshikawa | ..... | 320/107 |
| 6,236,621 | B1 | 5/2001 | Schettino | ..... | 368/10 |
| 6,753,760 | B2 | 6/2004 | Schwartz | ..... | 340/309.3 |
| 6,838,994 | B2 | 1/2005 | Gutta et al. | ..... | 340/575 |
| 7,355,928 | B2 * | 4/2008 | Nanda | ..... | 368/72 |
| 2002/0080035 | A1 | 6/2002 | Youdenko | ..... | 340/353.1 |
| 2003/0142591 | A1 | 7/2003 | Baweja et al. | ..... | 368/263 |

FOREIGN PATENT DOCUMENTS

DE 29918533 U1 * 2/2000

* cited by examiner

*Primary Examiner*—Edwin A. Leon
(74) *Attorney, Agent, or Firm*—James D. Wright; Chad D. Tillman; Tillman Wright, PLLC

(57) ABSTRACT

A self-moving alarm clock shakes the user awake in addition to providing an audible alarm. The device includes a housing with a cavity therein to house an alarm clock. A housing moving mechanism, which moves the housing from a first position to a second position, is electrically connected to the alarm clock. When an alarm signal is activated by the alarm clock upon an alarm event, the housing moving mechanism is activated to move the housing repeatedly from position to position. A switch on the housing is used to turn off the audible alarm and the housing moving mechanism. Since the switch is located on the housing which is moving, the user must locate, chase, pick up, then hold onto the housing during which time the user is shaken awake while they are turning off the alarm switch.

31 Claims, 10 Drawing Sheets

SELF-MOVING ALARM CLOCK

CROSS REFERENCE TO RELATED APPLICATIONS

This application is related to and claims priority from earlier filed provisional patent application Ser. No. 60/696,547, filed Jul. 6, 2005 and Ser. No. 60/772,512, filed Feb. 13, 2006.

BACKGROUND OF THE INVENTION

The invention relates generally to clocks and alarm clocks. These devices are typically employed by a user to assist them in determining the current time. Also, alarm clocks are used to alert a person when a given pre-set alarm time is now the current time. This is commonly used to assist a person in waking up for work or an appointment. For example, if the time is currently 10:00 pm and the user wishes to awake at 7:00 am the next day, they use an alarm clock to alert them when 7:00 am the next morning arrives. The alarm clock is set to the desired alarm time, e.g. 7:00 am, the night before so the alarm timely goes off.

In the prior art, alarm clocks are very well known. These devices are either mechanical or electronic in nature. In the example of a mechanical alarm clock, a mechanical time keeping mechanism with gears and springs are employed to keep time. Winding the clock or electrical power maintains the time keeping mechanism moving to, in turn, keep the time accurate and current. In a mechanical alarm clock, a hammer and bell are typically actuated at the alarm event to wake the user by a loud bell ringing sound.

In the case of electronic clocks, time keeping and alarms are similarly carried out. However, the time keeping and alarm setting are electronic in nature rather than mechanical. For example, a solid state clock, powered by batteries or AC power, enables accurate time keeping and alarm event triggering because the exact times can be set with precision, such as to the minute. Typical electronic alarm clocks sound a buzzer or beeper at the time of the alarm event at time of the user's choosing.

Despite the foregoing attempts in the prior to alert a user of the an alarm event time, audible sound alarm are frequently inadequate for effectively alerting the user to the alarm event, particularly if they are using the alarm clock to wake them out of deep sleep where they may be apt to do whatever is necessary to silence the audible alarm. In summary, these known audible alarm clocks are much too easy to turn off. For example, a user can simply reach over to their alarm clock on their nightstand from the comfort of their bed and depress an alarm shut off button to fully silence the alarm without ever really waking up when they want. This increases the risk that the person might sleep completely through their alarm as this routine does not require them to fully awaken nor open their eyes much. Also, a user can repeatedly hit a "snooze" button on the alarm clock to delay the alarm for a certain amount of time, such as 10 minutes, which lead to bad habits of waking up later than you intended.

There has been a number of attempts in the prior art to address these problems with prior art alarm clocks. There are various prior art alarm clocks that also include some type of vibration mechanism that can be actuated with or without the audible alarm sound. For example, an alarm clock, that can fit in a users pocket, can be provided with a vibration mechanism that actuates at the alarm time without an audible alarm so that a user can be silently alerted to an alarm time. These alarm clocks can also be provided with structures that fit under a pillow, or the like, to silently alert the user when it is time to wake up. In general, these vibrating alarm clocks are intended to be in a fixed location to silently alert the user of an alarm time.

Even though these prior art alarm clocks vibrate, they are still very easy to turn off by the user because they stay fixed in a single location. As a result, they are very easy to locate and handle by the user which enables the user to easily turn them off in similar fashion to an alarm clock with a simple audible alarm.

Still further, there have been attempts in the prior art to provide an alarm clock that moves from one location to another to makes it difficult for the user to easily turn it off to prevent them from sleeping through their alarm. For example, such a clock can include wheels to cause the alarm clock to roll away, off of the user's nightstand for example, to a location remote therefrom. In this prior art device, the alarm clock remains still and in a fixed location when the audible alarm goes off. However, if the "snooze" button is depressed, the entire alarm clock will roll away off of the nightstand until it hits a barrier, such as a wall. When the end of the "snooze" period is over, the user will have to find the device and then turn off the alarm. When the user finds this prior art device, it is essentially still with the exception that the wheels may still be rotating. If the alarm is immediately shut off, the audible alarm is silenced and the alarm clock will not move any further. Since this device is still when the alarm sounds and picked up by a user, it is very easy to turn off.

The foregoing prior art suffers from many problems. For example, prior art alarm clocks are too easy to turn off because they are easy to locate. The addition of vibration is for use as a silent alarm not for making it more difficult to turn off the alarm by the user. Rolling alarm clocks are similarly inferior because the alarm clock device is easy to retrieve, locate and hold by the user making it very easy to turn off the alarm.

In view of the foregoing, there is a demand for an alarm clock that is superior to currently available alarm clocks. There is a demand for an alarm clock that is more effective in waking up a user than prior art alarm clocks. There is a demand for an alarm clock fully awakens a person before they can turn them off. There is a demand for an alarm clock that engages a person to interact more to awaken them even more. There is yet another demand to provide an alarm clock that moves vigorously when an alarm event occurs to encourage the user to wake up. There is another demand for an alarm clock that can simultaneously sound an audible alarm and move about a user's environment to more effectively wake the user up. There is a demand for an alarm clock that shakes the user awake upon an alarm event.

SUMMARY OF THE INVENTION

The present invention preserves the advantages of prior art alarm clocks. In addition, it provides new advantages not found in currently available alarm clocks and overcomes many disadvantages of such currently available alarm clocks.

A self-moving alarm clock shakes the user awake in addition to providing an audible alarm. The device includes a housing with a cavity therein to house an alarm clock. A housing moving mechanism, which moves the housing from a first position to a second position, is electrically connected to the alarm clock. When an alarm signal is activated by the alarm clock upon an alarm event, the housing moving mechanism is activated to move the housing repeatedly from position to position. A switch on the housing is used to turn off the audible alarm and the housing moving mechanism. Since the switch is located on the housing which is moving, the user must hold the housing during which time the user is shaken awake while they are turning off the alarm switch.

It is therefore an object of the present invention to provide an alarm clock that is superior to currently available alarm clocks.

Another object of the present invention is to provide an alarm clock that is more effective in fully waking up a user than prior art alarm clocks.

A further object of the present invention is to provide an alarm clock that moves vigorously when an alarm event occurs.

Yet another object of the present invention is to provide an alarm clock that can simultaneously sound an audible alarm and continuously move about a user's environment to more effectively wake the user up.

Another object of the present invention is to provide an alarm clock that a user must chase around and capture upon an alarm event.

Another object of the present invention is to provide an alarm clock that shakes the user awake upon an alarm event.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
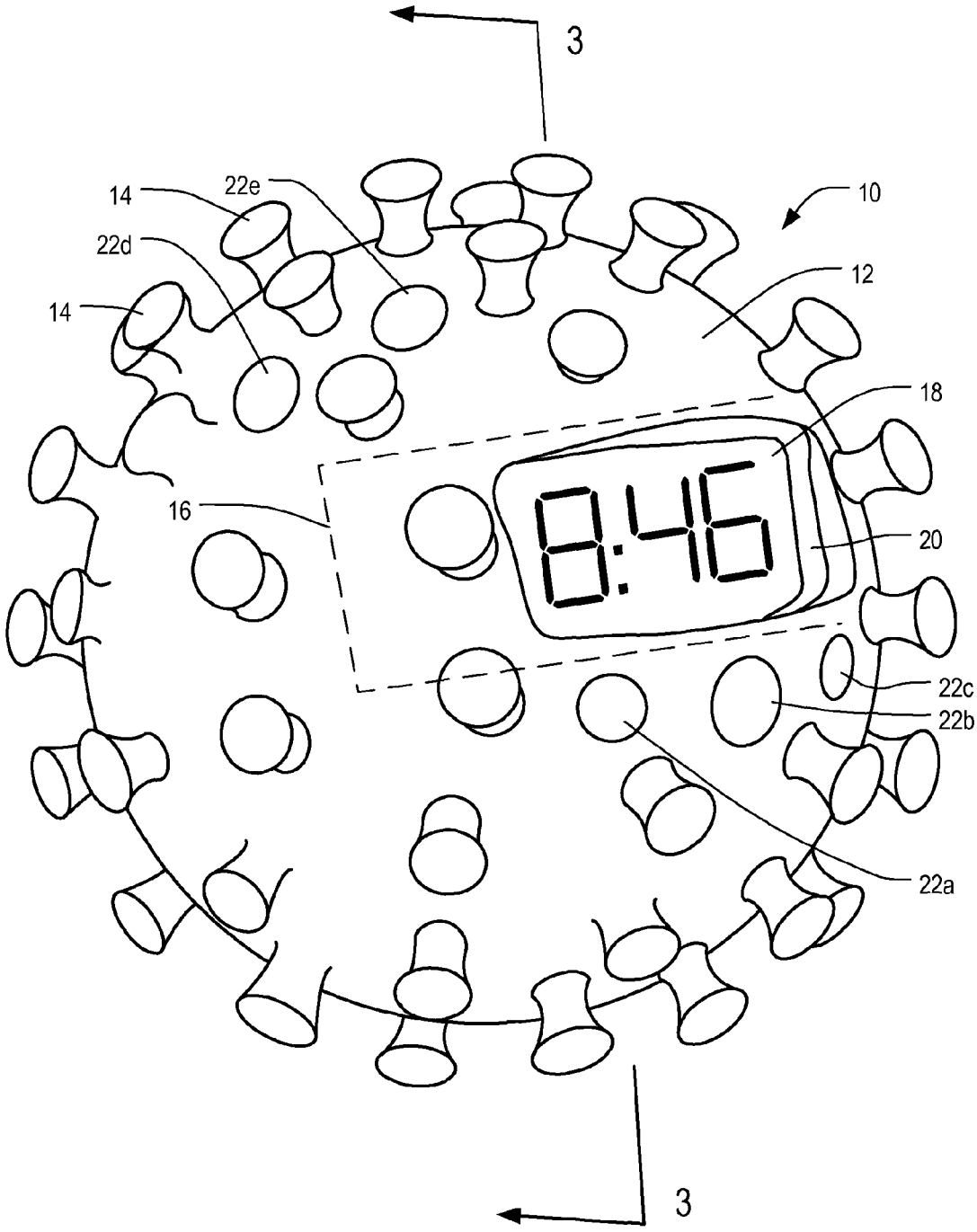
FIG. 1 is a front perspective view of the alarm clock device of the present invention.

Turning first to FIG. 1, a front perspective view of the alarm clock device 10 present invention is shown. A new and novel alarm clock device 10 includes a housing 12 with, preferably, a number of outwardly emanating protrusions 14 therefrom. These protrusions 14 help provide cushioning of the device 10 when it is moving about, as will be described in detail below. It should be understood that the device 10 is shown in the configuration of a generally spheroid structure with protrusions 14 thereon, however, the device 10 can be provided in any type of configuration, such as a cube without protrusions (not shown). Any configuration, with or without protrusions 14, are considered to be within the scope of the present invention.

Still referring to FIG. 1, an alarm clock component 16 is disposed within the housing 12, which is preferably of the electronic type for compactness and ease of manufacture. The alarm clock component 16 includes a display 18 which is visible through a window 20 in the housing 12. It is possible that the display 18 is a separate unit that is affixed to the outside of the housing 12 and electrically connected to the alarm clock component 16 via electrical wires, or the like. For example, a number of control buttons 22*a-e* are located on the housing 12 for controlling the setting of the current time, selection of an alarm time, setting an alarm and turning off of an alarm. An alarm control button, such as button 22*d*, is provided to enable the user to stop the alarm. A "snooze" button, such as button 22*e*, can optionally be used to delay the alarm for a predetermined period of time, such as 10 minutes. The foregoing button arrangement is just one example of a button arrangement that can be employed. Any arrangement and configuration of control buttons 22*a-e* can be used and still be within the scope of the present invention. The configuration and arrangement of the buttons in the figures are just one of many different button controls that can be used with the present invention.

These alarm control buttons 22*a-e* are electrically connected to the alarm clock component 16 residing within the housing 12. Further details of alarm clock components 16 and displays 18 and control buttons 22*a-e* therefore are so well known in the art that they need not be discussed in further detail herein. In fact, alarm clock components 16 are readily available as a separate unit for incorporation into any device that requires clock and alarm features.

Figure 2:
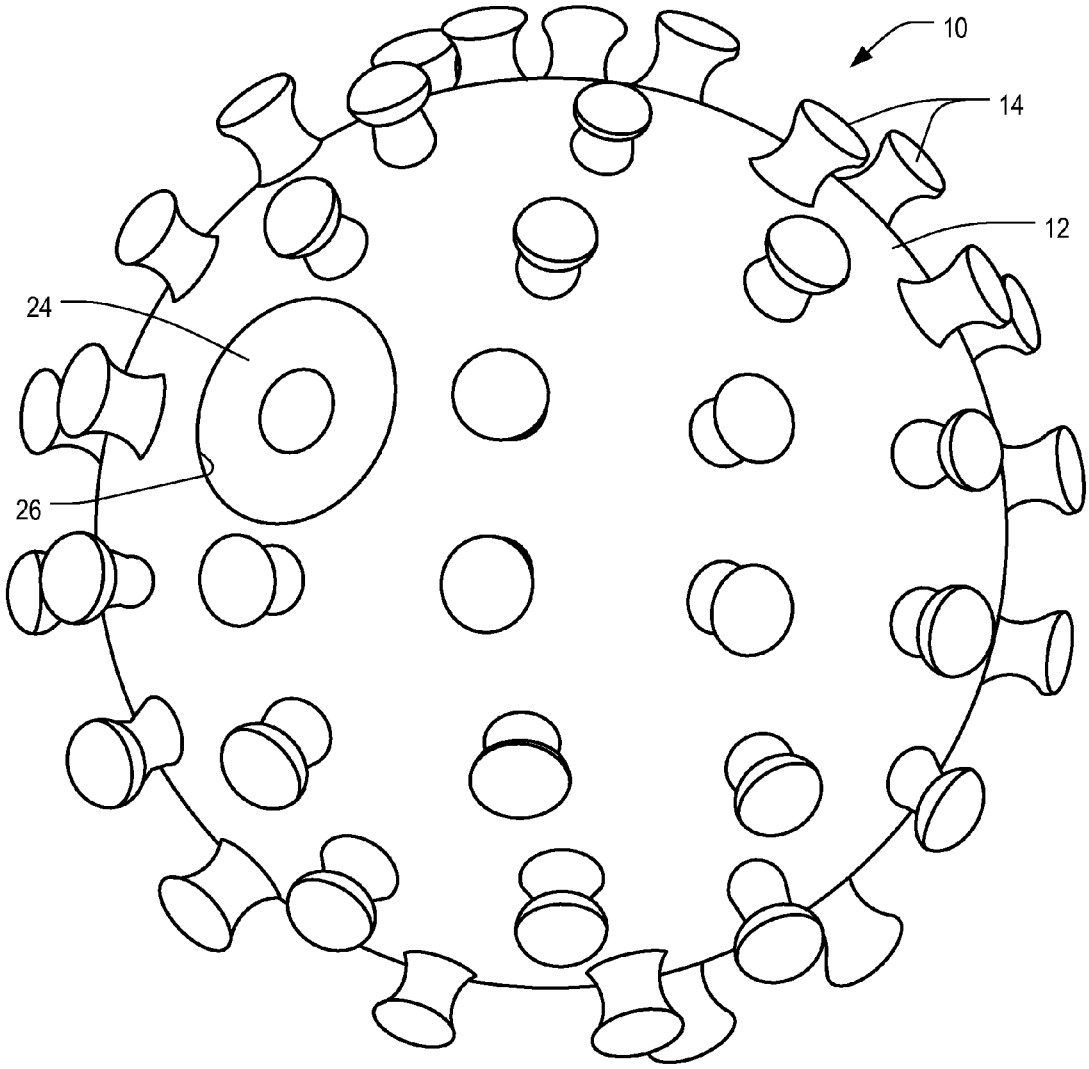
FIG. 2 is a rear perspective view of the alarm clock device of the present invention.

Turning now to FIG. 2, a rear perspective view of the alarm clock device 10 of the present invention is shown. A speaker 24 is provided through and aperture 26 in the housing 12 which is electrically interconnected to the alarm clock component 16 so that when an alarm event occurs, the desired sound is audibly heard. This speaker 24 can also be provided completely within the housing 12 rather that located through an aperture 26 in the housing 12. For example, a speaker 24 may be mounted directly to the alarm clock component 16 within the housing 12. Such a speaker 24 may be of a vibrating cone or piezoelectric type, for example. However, any type of speaker 24 can be used to connect to an audio output of the alarm clock component 16 within the housing 12.

Figure 3:
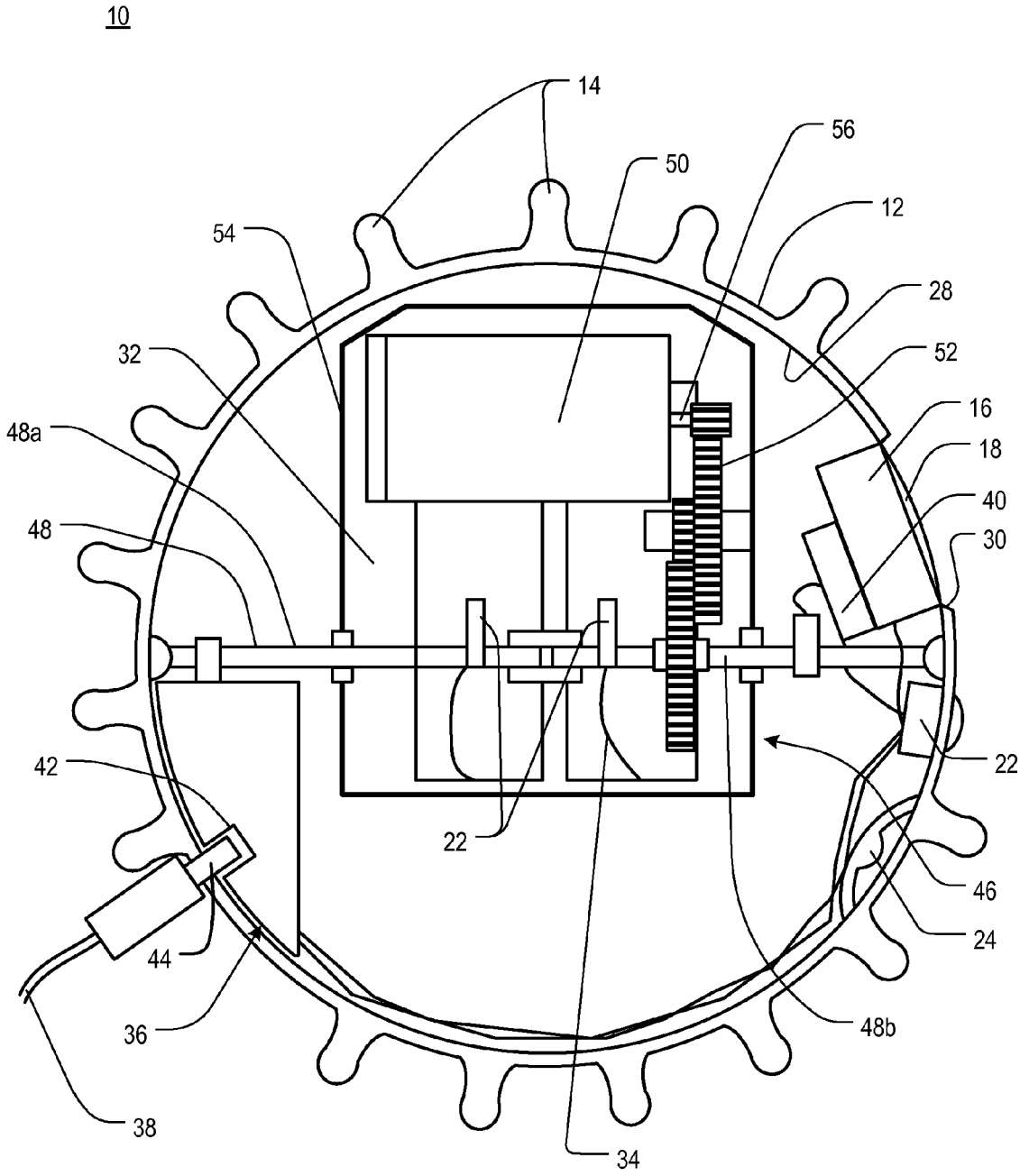
FIG. 3 is a cross-sectional view through the line 3-3 of FIG. 1.
Figure 4:
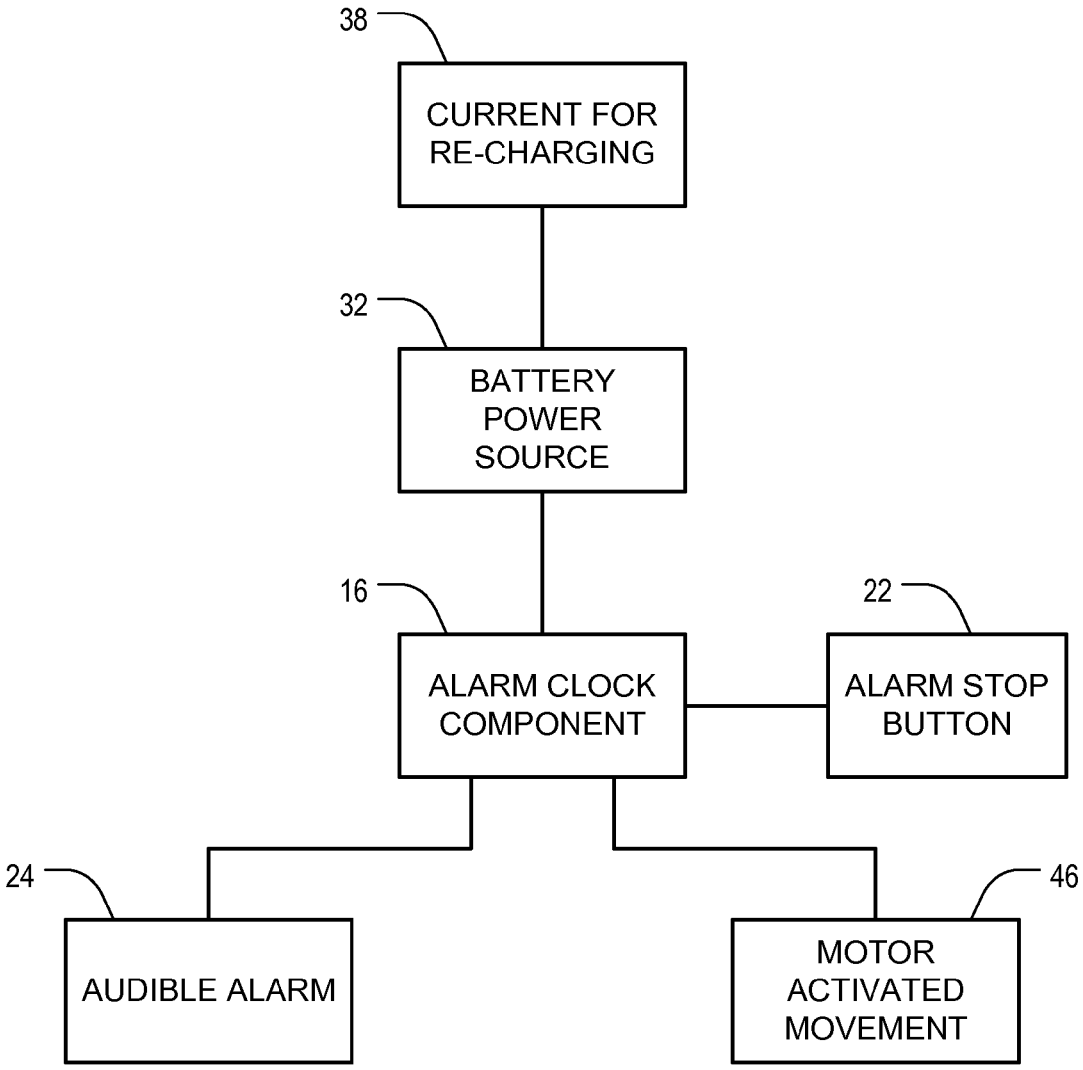
FIG. 4 is a schematic diagram of the electrical system of the alarm clock device of the present invention.

In FIG. 3, a cross-sectional view through the line 3-3 of FIG. 1 shows the details of the interior construction of the alarm clock device 10 of the present invention. FIG. 4 schematically shows the electrical interconnection of the primary components of the present invention. Referring both to FIGS. 3 and 4, the housing 12 includes the outwardly emanating protrusions 14, which can also be seen in FIGS. 1 and 2. An alarm clock component 16, which includes a display 18, is mounted on the interior surface 28 of the housing 12 so that the display 18 can be viewed from outside the housing 12, namely, through a window 30 in the housing 12. A power source 32, such as a pair of vertically oriented batteries supply power to the alarm clock component 16 via a number of wires 34.

An electrical interface 36 is provided within the housing 12 to electrically communicate with an exterior charging cable 38. An H-bridge type interconnection 40, for example, is preferably employed to control the power to the motor 32. Such an interconnection is well known in the art and need not be discussed in further detail herein.

In the example shown in FIG. 3, a female port 42 is provided in the housing 12 to receive a male plug 44. As a result, charging current is supplied to the power source, namely the batteries 32, so that alarm clock device 10 can operate wirelessly in a non-tethered condition. As stated above, the electrical interface 36 may be a magnetic plug, inductive pad or an electrical pad whereby the alarm clock device 10 can be freely separated from the charging source. This is particularly useful when the alarm clock device 10 is being used in conjunction with a docking station, as will be described in detail below in connection with FIG. 6.

A number of buttons, generally referenced in this figure as 22, are electrically interconnected to the alarm clock component 16 so that the operation thereof can be controlled and set. As stated above, the buttons 22*a-e* are used to set the current time, set the alarm time and turn on the alarm and turn it off. Functionality for "snooze" can also be included. The speaker 24 shown in FIG. 2 can also be seen in FIG. 3 which is also electrically interconnected to the alarm clock component 16. Thus, when the alarm time is reached, an audible alarm is sounded off via the speaker 24. The functionality of the above alarm clock is not limited in any way to the functionality described herein. Any alarm clock feature set can be employed and still be within the scope of the present invention.

Most importantly, a mechanism, generally referred to as 46, for vigorously moving the entire housing 12 is also electrically interconnected to the alarm clock component 16 in addition to the speaker 24, as can be seen in FIG. 4. Referring back to FIG. 3, the moving mechanism 46 preferably includes a centrally mounted main axle 48 upon which a motor 50 is eccentrically mounted thereto. The motor 50 is mechanically connected to the axle 48 via a series of gears 52 and resides within a motor housing 54. Thus, when the axle 56 of the motor 50 rotates, the gears 52 will rotate, causing the entire motor 50, within the motor housing 54, to rotate about the main axle 48. Such rotation of a weighted body, namely the motor housing 54, within the housing 12 causes the entire housing 12 to wobble about vigorously. As will be discussed below, this vigorous wobbling enables the present invention to be carried out effectively. A weighted motor housing 54 is just one example how to move the housing 12 to make it shake, wobble or otherwise move vigorously. Any such structure for causing this action is considered within the scope of the present invention.

Power may be delivered to the motor 50 in a number of different ways. As shown in FIG. 3, main axle 48 is split into two electrically isolated sides 48*a* and 48*b* whereby a positive and negative side of the electricity are delivered respectively thereto. Contact pads 58 within the motor housing 54 maintain contact with the respective sides 48*a*, 48*b* of the main axle 48 to maintain electrical contact with a source of power via cord 38. Thus, the motor housing 54 can rotate freely about the axle while still receiving electricity thereto.

Figure 8:
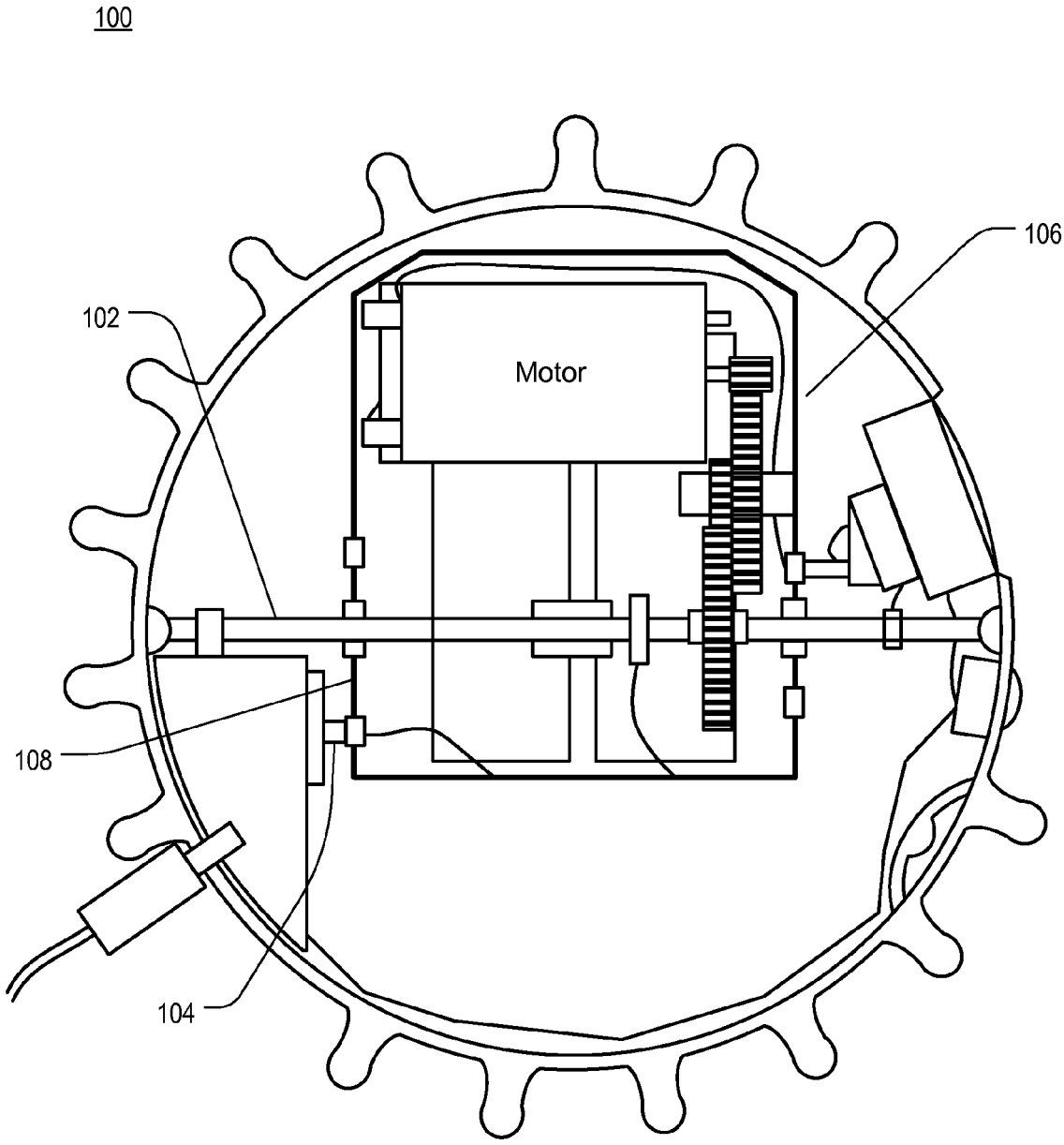
FIG. 8 is cross-sectional view of an alternative embodiment of the present invention.

Any type of movement, vibration or shaking mechanism for housing 12 can be used. The figures and discussion here are not intended to limit the overall scope of protection of the present invention. FIG. 8 shows a cross-sectional view of such an alternative embodiment 100 where a different mechanism is used to move the housing 12. This embodiment 100 uses a center axle 102 for electrical "positive" and whereas the electrical "negative" is brought into the housing by a brush pad 104 that continually keeps contact with the moving motor housing 106 through a circular contact point on the outside surface 108 of the housing 106. This is another example of how electricity can be delivered to a moving structure, such as a motor housing 106, to power it within the housing 12 to provide the required moving, shaking or vibration action.

It should be understood that the eccentrically mounted motor 50 is just one of many different examples that can be used in accordance with the present invention. Common motor assemblies may be used, such as those that use windings in conjunction with magnets. Other mechanisms for vigorous moving the main housing 12 can be employed.

Figure 5:
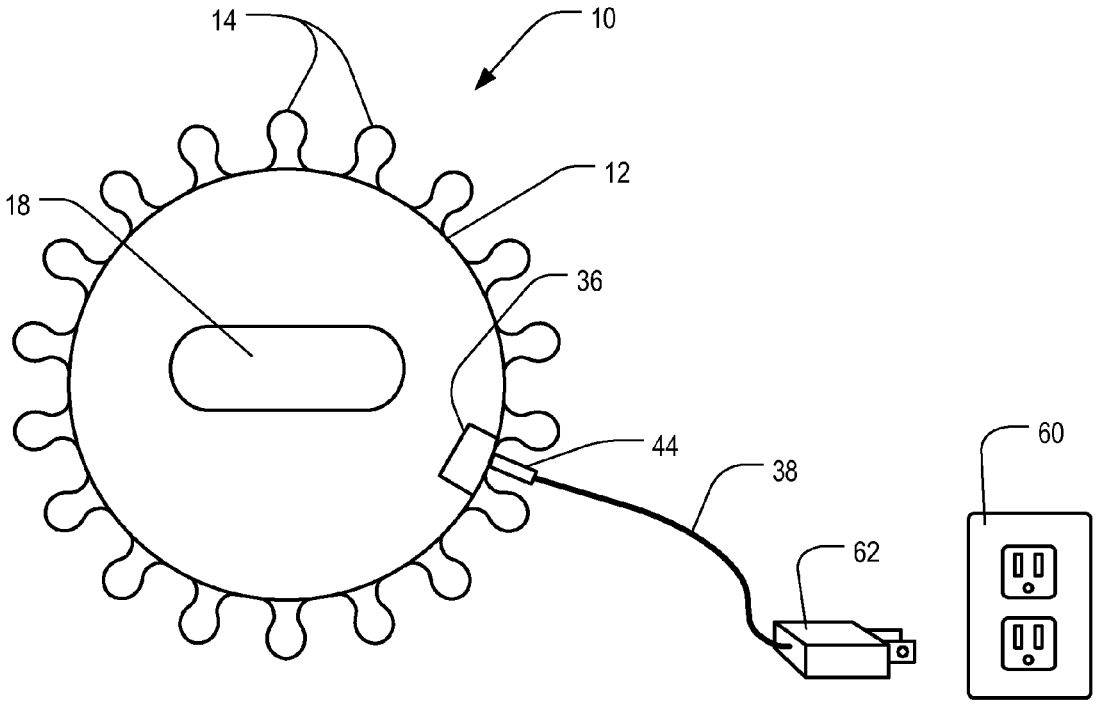
FIG. 5 is a front view of a power supply recharging system using in connection with the present invention.
Figure 6:
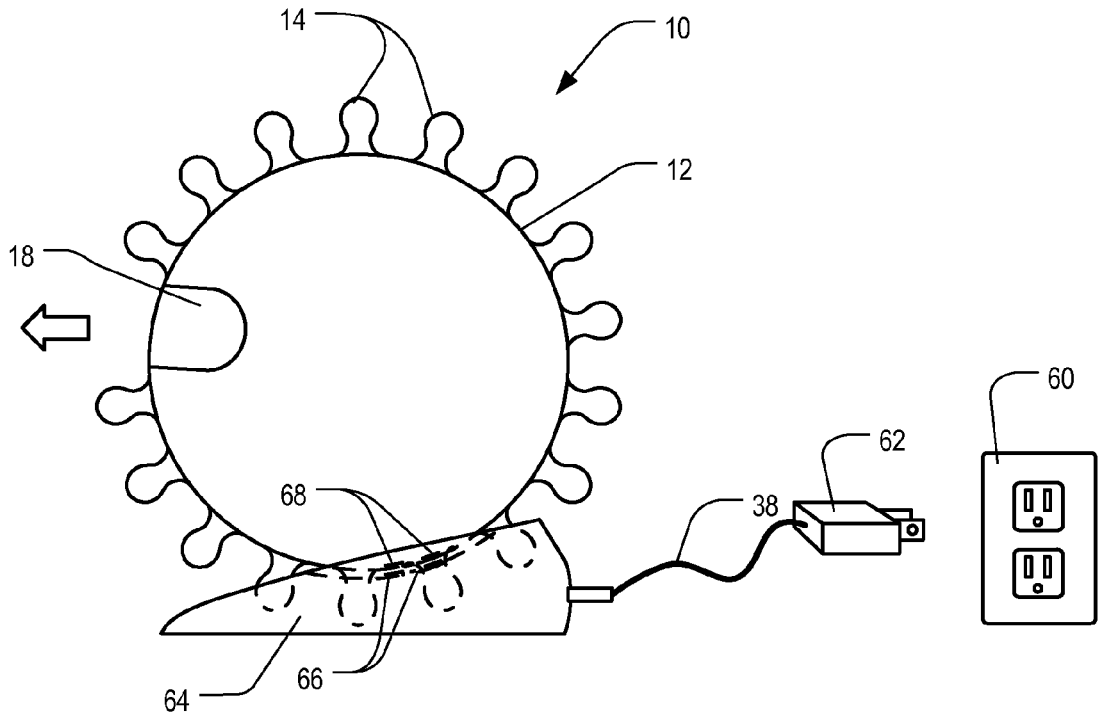
FIG. 6 is a front view of a dock power supply recharging system using in connection with the present invention.

Turning now to FIGS. 5 and 6, the alarm clock device 10 of the present invention may be stored in a number of different ways. For example, in FIG. 5, the alarm clock device 10 can be simply plugged into house current where a charging current is delivered to the batteries 32 via a electrical interface 44 on the charging cord and an electrical interface 36 in the housing 12. In this example, a plug 44 is used as an electrical interface, as in FIG. 3, to provide charging current from a wall socket 60 via a plug 62 and cord 38. When it is time to use the alarm clock device 10, it is unplugged after charging and simply placed in the desired location. When the alarm time arrives, the alarm clock device 10 will vigorously move about, as described above.

Referring now to FIG. 6, a dock 64 is employed for storage of the alarm clock device 10 when not in use. During this time, the power source, which are preferably rechargeable batteries, are recharged by house current via the wall plug 62 plugged into a wall outlet 60 with cord 38 and dock 64. The dock 64 includes pair of frictionless contact pads 66 that electrically communicate with frictionless contact pads 68 on the housing 12 of the alarm clock device 10. As a result, when the alarm clock device 10 is residing on the dock 64, it recharges while it is being neatly stored. As stated above, magnetic or inductive pad can be used to reduce if not eliminate the frictional interconnection of housing 12 to the dock 64.

It is highly desirable for the housing 12 to be electrically interconnected to the wall outlet 60 for charging but to be loosely physically interconnected to the dock 64 so that it may freely launch from the dock 64, for example, in the direction of the arrow when an alarm event occurs. In fact, the housing 12 may launch in any direction, if desired. In particular, vigorous wobbling of the housing 12 will cause the alarm clock device 10 to launch from the dock 64 so that it will immediately begin to move about in a fashion that will require the user to get up out of bed, locate it, chase after it, capture it, get shaken awake, and then turn it off.

Figure 7A:
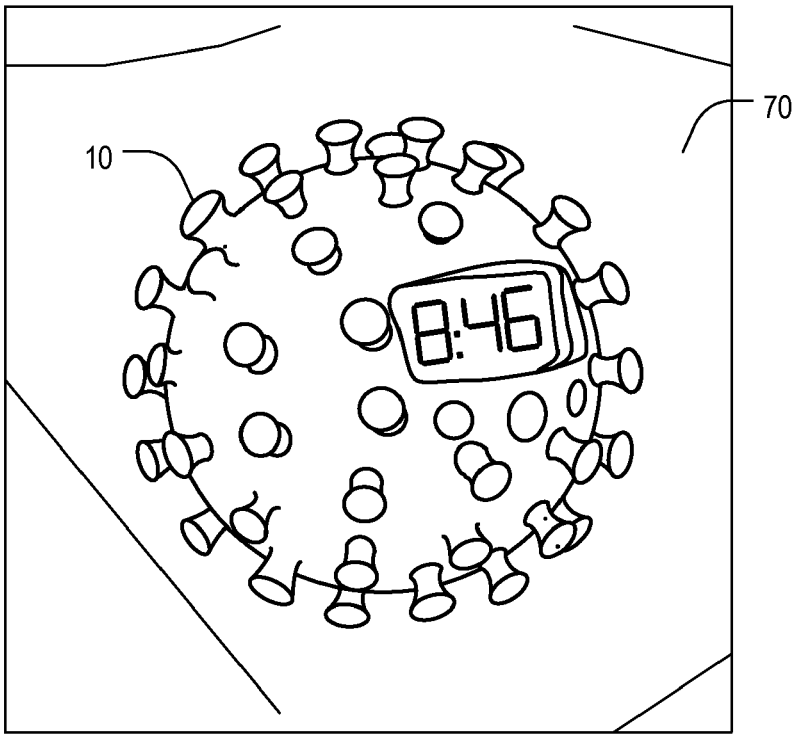
FIGS. 7A-F show the steps of waking a user in accordance with the method of the present invention.
Figure 7B:
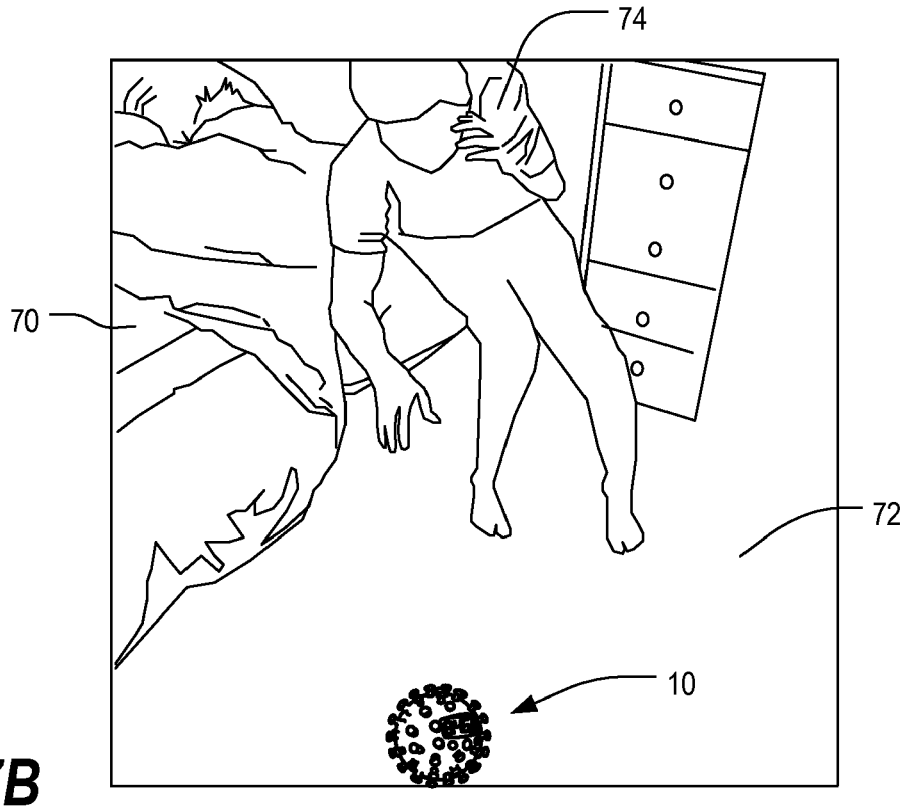

Turning now to FIGS. 7A-F, the method of waking a user is shown in detail. In FIG. 7A, the alarm clock device 10 of the present invention is set with a desired alarm time. The alarm is then set and the device 10 is positioned where desired, such as on a nightstand next to the user's bed 70. In FIG. 7B, the previously set alarm time is reached and the alarm clock device 10 is launched from a nightstand onto the floor 72 nearby while sounding an audible alarm. The user 74 is required to get out of bed 70 and locate the alarm clock device 10 during which time the device 10 is moving vigorously about the room making it difficult for the user 74 to locate and chase around. Even when in a corner or against a wall, the device 10 of the present invention continues to move making it difficult for the user 74 to locate and pick it up.

Figure 7C:
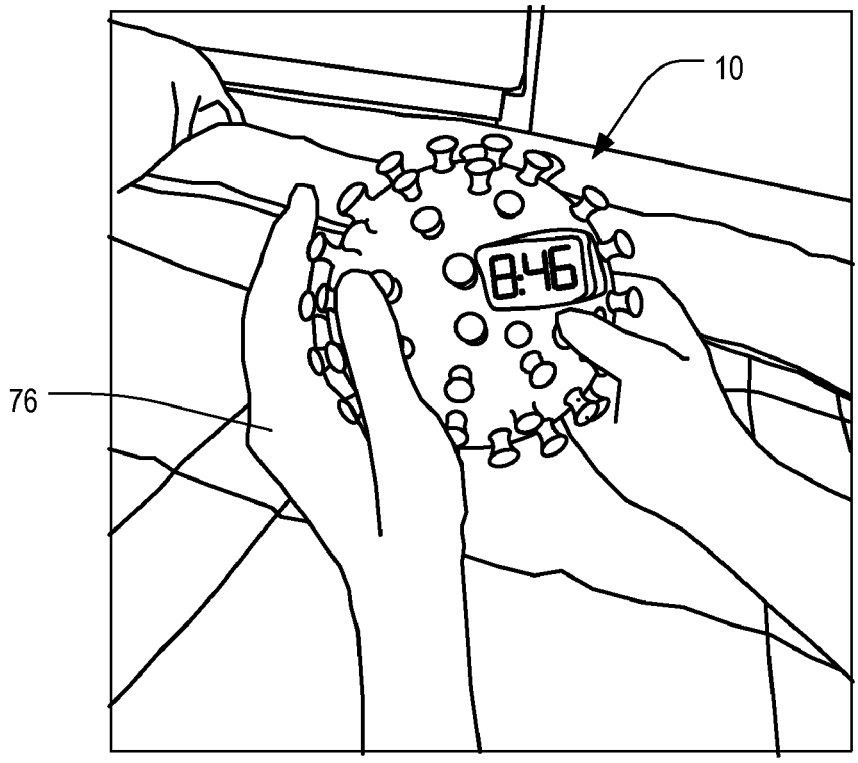
Figure 7D:
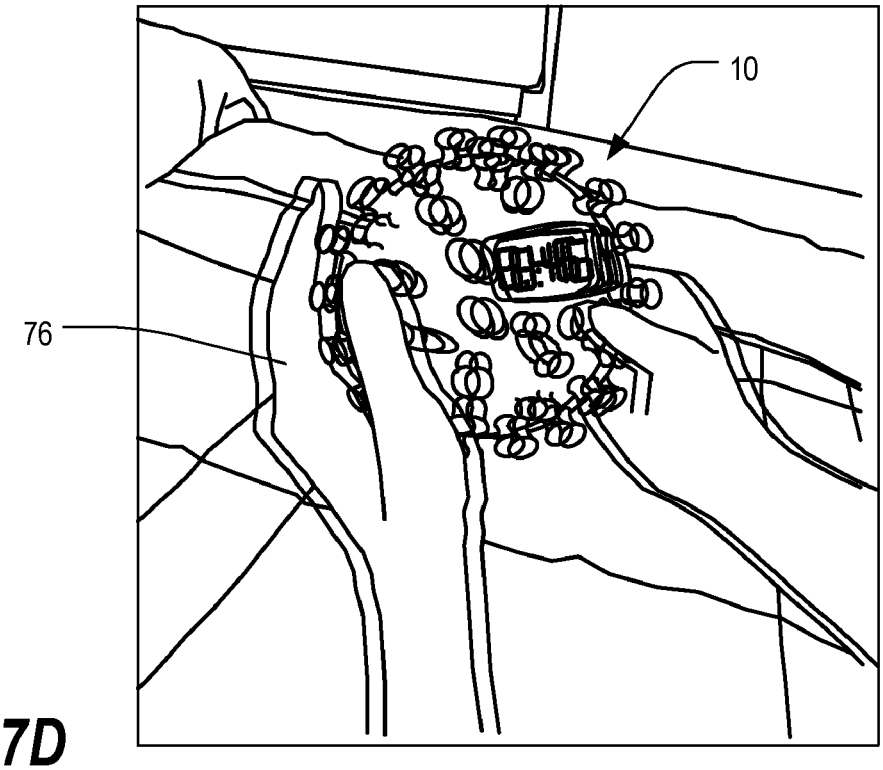

In FIG. 7C, the user 74 has finally located the alarm clock device 10 and has picked it up and is now holding it in their hands 76. Due to the level of the movement and shaking, the user 74 typically needs to hold the device in both hands 76. In FIG. 7D, the device 10 continues to actively move about gradually shaking the user 74 awake quickly while still sounding the audible alarm. However, the shaking and audible alarm will continue to sound until the alarm switch 22 is turned off.

Figure 7E:
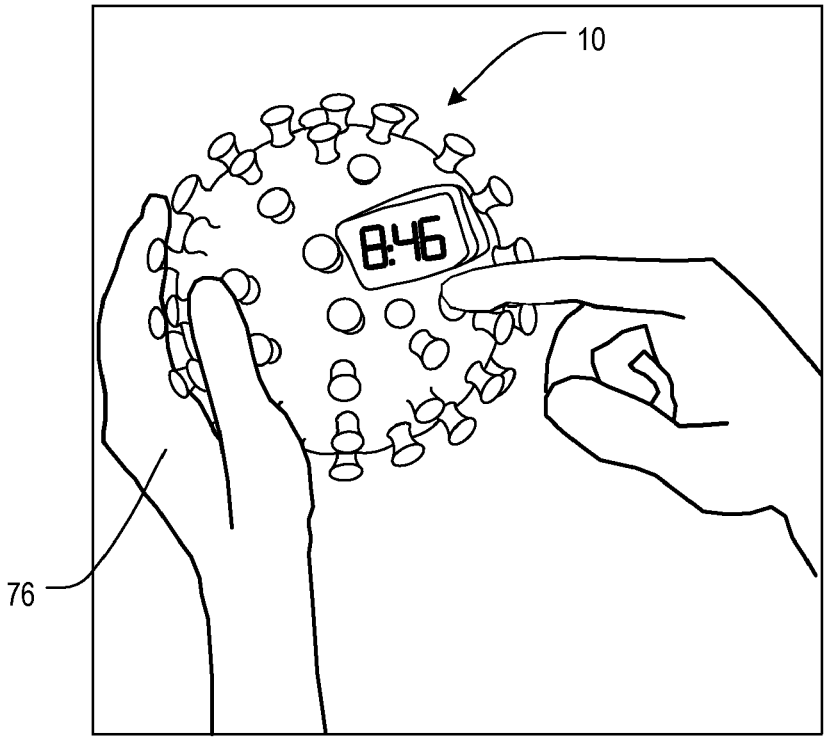
Figure 7F:
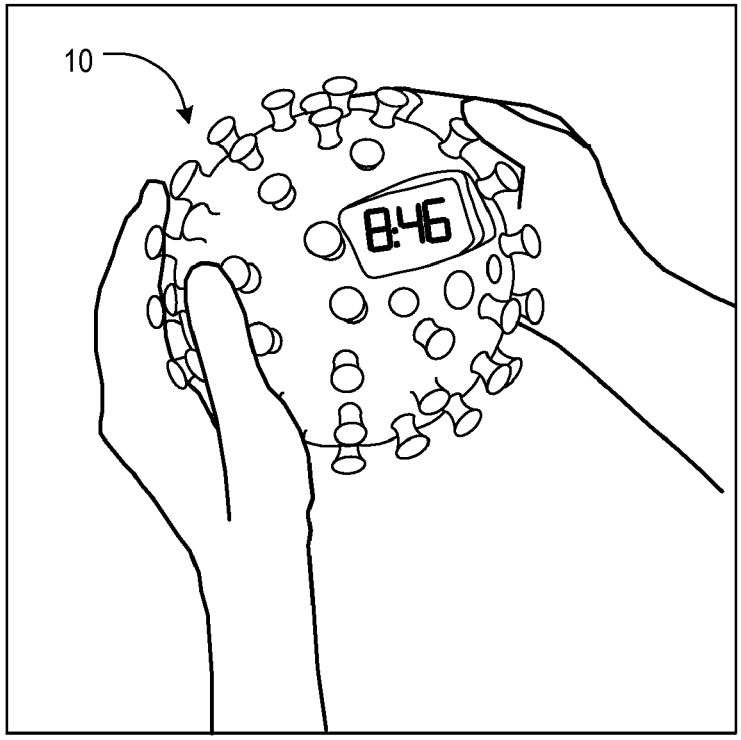

In FIG. 7E, the user 74 has located the alarm switch 22 and has depressed it. As a result, as seen in FIG. 7F, the movement of the alarm clock device 10 has stopped and the audible alarm has ceased to sound. The alarm clock device 10 can now be returned to the desired location in preparation for the next alarm event, such as back in its dock or any location if it is charged up.

This moving mechanism 46 is intended to supplement the hearing sensation of the user 74 with a feeling sensation when waking up. In other words, the user 74 is shaken awake when the device 10 is picked up at the time to shut off the alarm. The ability to shake awake the user 74 while they are holding the device in their hands 76 because they have just retrieved it after moving about the room is new and novel and not found in the prior art. The alarm clock 10 of the present invention requires that the user chase it not merely try to find in prior art devices. The key different is that the user must not only find the device 10 but it is required to chase it, then catch and perhaps even wrestle with it into order to, in turn, successfully turn it off. Prior art devices not require such action on the part of the user.

Also, the moving mechanism 46 shakes the housing 12 to such an extent that it makes a repeated impact to the surface on which it sits, such as a nightstand. This impact is louder than a simple vibration mechanism in prior art alarm clocks, which are similar to those found in mobile phones. The repeated impact makes a knocking type sound which is disturbing not only to the user 74 but his or her neighbors. This encourages the user 74 to quickly locate the alarm clock device 10 of the present invention, get shaken awake and then turn it off.

The alarm clock device 10 of the present invention can be made of many different types of materials, such as plastic and metal. A plastic or rubber housing 12 is preferably used to avoid damage to surrounding items, such as furniture. The housing 12 may be brightly colored and may include lights, such as those of the flashing type, to enhance the overall aesthetic appeal of the device 10 and to visually alert the user 74. Such lights may be used a supplemental or alternative way to waking the user up as stimulates another sense of the user, namely the visual sense. Spinning or blinking lights are another way to awaken a person though this sense in similar fashion to sun or when someone turns on the lights early in the morning.

It would be appreciated by those skilled in the art that various changes and modifications can be made to the illustrated embodiments without departing from the spirit of the present invention. All such modifications and changes are intended to be covered by the appended claims.

What is claimed is:

1. A self-moving alarm device comprising:

(a) an alarm clock device, including:

a housing having a cavity and an electrical interface therein, an alarm clock residing in the cavity, and an off-set motor, pivoted in a center of the housing, that acts as a weight for moving the housing from a first position to a second position, the motor being electrically connected to the alarm clock, the alarm clock activating the off-set weight, causing the off-set weight to spin, thereby moving the housing, when an alarm of the alarm device is activated; and (b) an electrically powered dock having a top surface on which the housing rests when the alarm clock device is deactivated, the dock being configured to charge the alarm clock device via the electrical interface, and the dock being further configured to allow the alarm clock device to dislodge from the top surface of the dock when the alarm is activated.

2. The self-moving alarm device of claim 1, further comprising:

a plurality of protrusions emanating outwardly from the housing.

3. The self-moving alarm device of claim 1 wherein the housing is spheroid in configuration.

4. A method of waking a person, comprising the steps of:

providing a housing with an alarm clock residing in a cavity therein;

providing a means for moving, which is electrically connected to the alarm clock, within the housing, the means for moving including an off-set motor, pivoted in a center of the housing, that acts as a weight;

setting an alarm time on the alarm clock;

generating an alarm signal when the current time reaches the alarm time;

activating the means for moving when the alarm signal is generated at an alarm time;

awakening a user by:

repeatedly moving the housing from position to position, requiring the user to chase and capture the housing, by causing the off-set weight to spin, thereby moving the housing, and shaking the user awake when the user is holding the housing; and deactivating the alarm signal thereby stopping the housing from moving further.

5. The method of claim 4, further comprising the steps of:

providing a speaker electrically connected to the alarm clock; and generating an audible sound upon activation of the alarm.

6. The method of claim 4, further comprising the steps of:

displaying current time and alarm time information on a display that is electrically connected to the alarm clock and viewable by the person from outside the housing.

7. The method of claim 4, wherein the means for moving includes a vibrating device.

8. The method of claim 4, wherein the means for moving includes an offset weight.

9. The method of claim 4, wherein the alarm clock is mechanical.

10. The method of claim 4, wherein the alarm clock is electronic.

11. The method of claim 4, wherein the means for moving is omni-directional.

12. The method of claim 4, further comprising the steps of:

impacting the housing into a support surface upon which the housing is positioned;

creating an audible sound by impacting of the housing into the support surface; and creating a vibration in the support surface by impacting the housing into the support surface.

13. The method of claim 4, further comprising the steps of:

supplying electricity to the alarm clock and the means for moving from a battery power source.

14. The method of claim 13, wherein the battery power source is rechargeable.

15. The method of claim 4, wherein the alarm device is deactivated by a switch.

16. The method of claim 4, further comprising the step of:

knocking the housing into a surface and generating a loud audible sound therefrom.

17. The method of claim 4, further comprising the steps of:

providing a dock;

maintaining the housing on the dock when the alarm clock is deactivated; and launching the housing from the dock upon activation of the alarm clock.

18. The method of claim 17, further comprising the steps of:

providing an electrical interface on the dock;

supplying electricity to the electrical interface on the dock;

providing an electrical interface on the housing which is in electrical communication with a rechargeable battery power source for powering the alarm clock and the means for moving; and supplying electricity to the battery power source, for charging thereof, when the housing resides on the dock with the electrical interface on the dock in electrical communication with the electrical interface on the housing.

19. A self-moving alarm device comprising:

(a) an alarm unit, including:

(i) a housing having a cavity and an electrical interface therein, (ii) an alarm clock residing in the cavity, and (iii) a motor for moving the housing from a first position to a second position, the motor being electrically connected to the alarm clock, the alarm clock activating the motor when an alarm of the alarm unit is activated; and (b) an electrically powered dock having a top surface on which the housing rests when the alarm unit is deactivated, the dock being configured to charge the alarm unit via the electrical interface, and the dock being further configured to allow the alarm unit to dislodge from the top surface of the dock when the alarm is activated.

20. The self-moving alarm device of claim 19, further comprising:

a speaker electrically connected to the alarm clock to generate an audible sound upon activation of the alarm.

21. The self-moving alarm device of claim 19, further comprising:

a display electrically connected to the alarm clock to display current time and alarm time information; the display residing on the housing and being viewable by a user.

22. The self-moving alarm device of claim 19, wherein the alarm unit includes a vibrating device for moving thereof.

23. The self-moving alarm device of claim 19, wherein the alarm unit includes an offset weight for facilitating movement thereof.

24. The self-moving alarm device of claim 19, wherein the alarm clock is mechanical.

25. The self-moving alarm device of claim 19, wherein the alarm clock is electronic.

26. The self-moving alarm device of claim 19, wherein the alarm unit includes an omni-directional means for movement.

27. The self-moving alarm device of claim 19, wherein the alarm unit creates an audible sound by impact of the housing into a support surface upon which the housing is positioned.

28. The self-moving alarm device of claim 19, further comprising:

a battery power source electrically connected to the alarm clock to power the alarm clock and the motor.

29. The self-moving alarm device of claim 28, wherein the battery power source is rechargeable.

30. The self-moving alarm device of claim 19, further comprising:

a means for deactivating the alarm device.

31. The self-moving alarm device of claim 30, wherein the means for deactivating the alarm device is a switch.

* * * * *